United States Patent [19]

Hare

[11] 4,284,456

[45] * Aug. 18, 1981

[54] METHOD FOR TRANSFERRING CREATIVE ARTWORK ONTO FABRIC

[76] Inventor: Donald S. Hare, 4 Lexington Ave., New York, N.Y. 10010

[ * ] Notice: The portion of the term of this patent subsequent to Sep. 23, 1997, has been disclaimed.

[21] Appl. No.: 87,767

[22] Filed: Oct. 24, 1979

Related U.S. Application Data

[63] Continuation-in-part of Ser. No. 954,228, Oct. 24, 1979, Pat. No. 4,224,358.

[51] Int. Cl.[3] ..... B44C 31/00; B41C 3/12; B21C 1/00

[52] U.S. Cl. ..... 156/234; 156/235; 156/240; 427/148; 428/914

[58] Field of Search ..... 156/234, 236, 240, 299, 156/230, 246, 235; 427/147, 148, 152; 428/914; 35/26

[56] References Cited

U.S. PATENT DOCUMENTS

| | | | |
|---|---|---|---|
| 3,095,649 | 7/1963 | Wightwick | 156/240 |
| 3,578,525 | 5/1971 | Mueller | 156/238 |
| 4,075,049 | 2/1978 | Wood | 156/240 |
| 4,089,722 | 5/1978 | Holoubek | 156/299 |
| 4,145,244 | 3/1979 | Corey | 156/240 |

FOREIGN PATENT DOCUMENTS

| | | | |
|---|---|---|---|
| 7108470 | 6/1971 | Netherlands | 156/234 |

*Primary Examiner*—Caleb Weston

*Assistant Examiner*—Louis Falasco

*Attorney, Agent, or Firm*—Birch, Stewart, Kolasch & Birch

[57] ABSTRACT

A method and kit for transferring creative free-hand artwork or patterns onto a T-shirt or similar fabric is described. The transferable pattern is created from a manifold of a heat transfer sheet and a reverse or lift-type copy sheet having a pressure transferable coating of heat transferable material thereon. By generating the pattern or artwork on the obverse face of the transfer sheet with the pressure of a drafting implement a heat transferable mirror image pattern is created on the rear surface of the transfer sheet by pressure transfer from the copy sheet, which can then be applied to a T-shirt or other article by heat transfer. To provide interesting background colors and patterns on the T-shirt on which the free-hand artwork is superimposed the rear surface of the transfer sheet may be coated with a negative image of the background pattern formed from heat transferable inks. The transfer sheet may be transparent so the negative background image on the rear of the transfer sheet is visible as a positive image through the obverse surface.

In the alternative the background image, or at least an outline thereof, may be printed on the obverse surface of the transfer sheet as a guide or framework in which the free-hand artwork is performed. The free-hand artwork and background pattern are then transferable together from the rear surface of the transfer sheet to the T-shirt or similar fabric.

2 Claims, 12 Drawing Figures

METHOD FOR TRANSFERRING CREATIVE ARTWORK ONTO FABRIC

This is a continuation-in-part application of Ser. No. 954,228, filed Oct. 24, 1979 now U.S. Pat. No. 4,224,358.

BACKGROUND OF THE INVENTION

1. Field of the Invention

The present invention is directed to a method and kit for transferring free-hand artwork and colored backgrounds to a T-shirt or the like.

2. Description of the Prior Art

Many exemplary heat transferable or pressure transferable decals for placing a color emblem on a fabric or other receptor sheet are illustrated in the prior art. For example, U.S. Pat. No. 2,071,163 to Emmey discloses a transfer sheet 13 having colored areas 14, 15 thereon formed from a heat transferable wax. The heat transferable wax 14, 15 is applied to the transfer sheet 13 in a melted state at the time of manufacture of the transfer sheet.

U.S. Pat. Nos. 2,217,270 to Gibbs and 2,688,579 to Meyer disclose other forms of precolored transfer sheets. The transfer sheets in these patents, like the transfer sheet of Emmey, are precolored at the time of manufacture of the transfer sheet.

U.S. Pat. Nos. 3,783,073 to Warnberg and 4,038,123 to Simms disclose devices for transferring outlines of indicia to fabrics.

Each of the foregoing patents suffers from the disadvantage that they do not permit or encourage creative artwork in the design transferred to the fabric by the consumer.

At least one custom coloring procedure for applying color designs to T-shirts or other fabrics is known. In this procedure, fabric crayons are sold separately in combination with T-shirts, which have outlines of the designs applied thereto, and the consumer uses the fabric crayons to color directly on the fabric or the T-shirt. This method of coloring is totally unsatisfactory, since the flexibility of the fabric prevents smooth and fluid strokes and creates tension which prevents an even application of color from the crayons.

Another custom coloring procedure for transferring coloring designs to materials other than fabrics is described in U.S. Pat. No. 3,785,912 to Van Duesen, which discloses transferring a pattern or outline to a receptor sheet and subsequently coloring the receptor sheet with a conventional felt tip pen. This is essentially the same procedure described above with respect to the custom coloring of T-shirts.

All of the transfer kits and techniques of the prior art suffer from the disadvantage outlined above which are overcome by the method and kit of the present invention which provides a method and kit for transferring creative free-hand artwork to a T-shirt or the like.

The transferable pattern is created from a manifold of a heat transfer sheet and a reverse or lift-type copy sheet having a pressure transferable coating of heat transferable material thereon. By generating a free-hand pattern on the obverse face of the transfer sheet with the pressure of a drafting implement, such as a pencil, pen or stylus, a heat transferable mirror image pattern is created on the rear face thereof by pressure transfer which can be applied to a T-shirt or other article by heat transfer.

To provide interesting background colors and patterns on the T-shirt on which the free-hand artwork is superimposed the rear surface of the transfer sheet may be coated with a negative image of the background pattern formed from heat transferable inks. The transfer sheet may be transparent so the negative background image on the rear of the transfer sheet is visible as a positive image through the obverse surface.

In the alternative the background image, or at least an outline thereof, may be printed on the obverse surface of the transfer sheet as a guide or framework in which the free-hand artwork is performed. The free-hand artwork and background pattern are then transferable together from the rear surface of the transfer sheet to the T-shirt or similar fabric.

SUMMARY OF THE INVENTION

It is an object of the present invention to provide a kit for applying colored artwork to a T-shirt or the like.

A further object of the present invention is to provide a transfer sheet which includes the outline of a mirror image of a specific free-hand message together with any desired fanciful background design.

Another object of the present invention is to provide a kit which will encourage consumer involvement and utilize the talents and creativity of the consumer in generating the design.

Yet another object of the present invention is to provide a combined transfer sheet and copy sheets wherein the copy sheets are coated with a pressure transferable heat transferable material and a mirror image pattern is generated on the reverse face of the transfer sheet from the copy sheets in response to a pressure generating drafting implement applied to the obverse face of the transfer sheet to generate a desired pattern on that obverse face, the transfer sheet being subsequently used to apply the mirror image pattern, by heat transfer, to a T-shirt or other article.

Although it is preferred to transfer the colored design from the transfer sheet to the fabric by the application of heat, other forms of energy than heat may be utilized. For example, pressure may be applied such as by rubbing or stamping, to effect transfer of the colored design.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus is not limitative of the present invention, and wherein.

Figure 1:
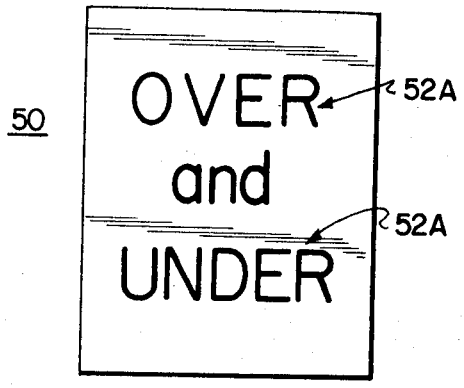
FIG. 1 is a top plan view of a transfer sheet illustrating the obverse face thereof and a pattern thereon.

Referring in detail to FIGS. 1 to 4 there is shown a transfer sheet 50 having an obverse surface 50A and a reverse surface 50B with a pattern, hereinafter referred to as the obverse pattern 52A either printed upon or adapted to be generated upon the obverse surface 50A by free-form drafting.

A copy sheet 54 is provided which has a surface layer 56 consisting of a pressure transferable and heat transferable colored wax or other suitable substance having these characteristics over a substrate 58 of conventional paper or plastic or the like, the substrate 58 acting as a supporting surface for the transferable wax or other material 56.

The copy sheet 54 is manifolded with the transfer sheet 50 such that the transferable material layer 56 is juxtaposed with the reverse surface 50B of the copy sheet 50.

Figure 2:
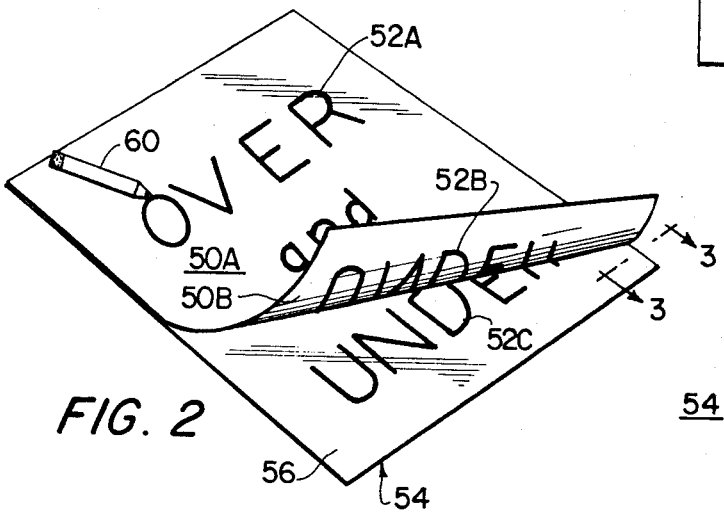
FIG. 2 is an illustration of a manifold combination of a transfer sheet of the present invention and a copy sheet of the present invention with a mirror image pattern having been transferred to the reverse face of the transfer sheet from the copy sheet.
Figure 3:
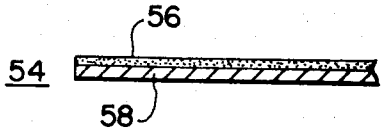
FIG. 3 is a detailed partial cross-section of a copy sheet of the present invention taken along line 3—3 of FIG. 2.

Then, as illustrated in FIG. 2, if a drafting implement 60 such as a pencil, ball pen, or the like is utilized to either generate the obverse pattern 52A or trace over the obverse pattern 52A on the obverse surface 50A, the pressure of the tracing or drafting point of the implement 60 will cause a mirror image transfer pattern 52B to be lifted from a counterpart pattern 52C on the copy sheet 54 due to the pressure transferable characteristics of the material layer 56 on the copy sheet 54.

At this point, the transfer sheet 50 is peeled upward as illustrated in FIG. 2 from the copy sheet 54 to separate it from the previously manifolded copy sheet for the purpose of next transferring the mirror image transfer pattern 52B to the surface of the T-shirt 62 or the like.

Figure 4:
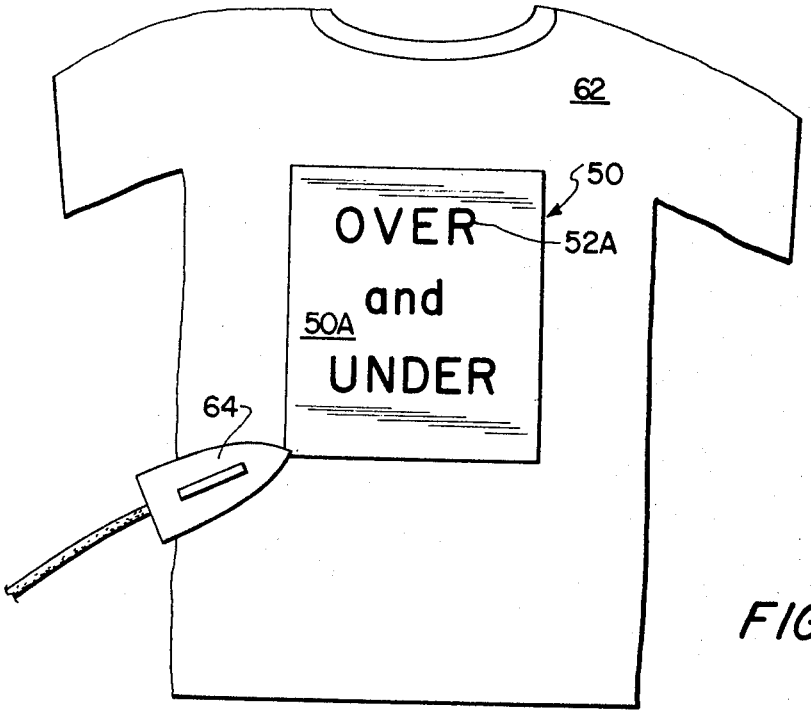
FIG. 4 is a schematic illustration of a heat transfer of a mirror image from the reverse side of the transfer sheet to a T-shirt or the like by engaging the obverse surface and the obverse pattern with a hand-held iron or other heat applying implement.

As then shown in FIG. 4, the obverse pattern 52A is utilized as a visual registry to determine the proper position of the transverse sheet 50 on the T-shirt 62. A heating iron 64 is then pressed against the obverse surface 50A and obverse image 52A of the transfer sheet 50 the thereby transfer the transferable mirror image 52B onto the T-shirt 62.

In the event that a multicolored mirror image is desired to thereby provide a multicolored transferred image on the T-shirt 62, then various portions of the obverse design 52A could be generated or traced with a different selected copy sheet 54 placed beneath the reverse surface 50B of the transfer sheet during those selected traces. These selected copy sheets 54 would be coated with different colored transferable layers 56 for the purpose of providing respectively selected colors to various portions of the transferable mirror image 52B on the reverse surface 50B of the transfer sheet 50.

The resulting multicolored mirror image would then be heat transferable to the T-shirt as previously described.

To provide interesting background colors and patterns on the T-shirt on which the free-hand artwork is superimposed the rear surface 50B of the transfer sheet may be coated with a negative image of the background pattern formed from heat transferable inks. The transfer sheet may be transparent so the negative background image on the rear of the transfer sheet is visible as a positive image through the obverse surface 50A.

In the alternative the background image on surface 50B or at least an outline thereof, may also be printed on the obverse surface of the transfer sheet as a guide or framework in which the free-hand artwork is performed. The free-hand artwork and background pattern are transferable together from the rear surface 50B of the transfer sheet to the T-shirt or similar fabric.

Figure 5A:
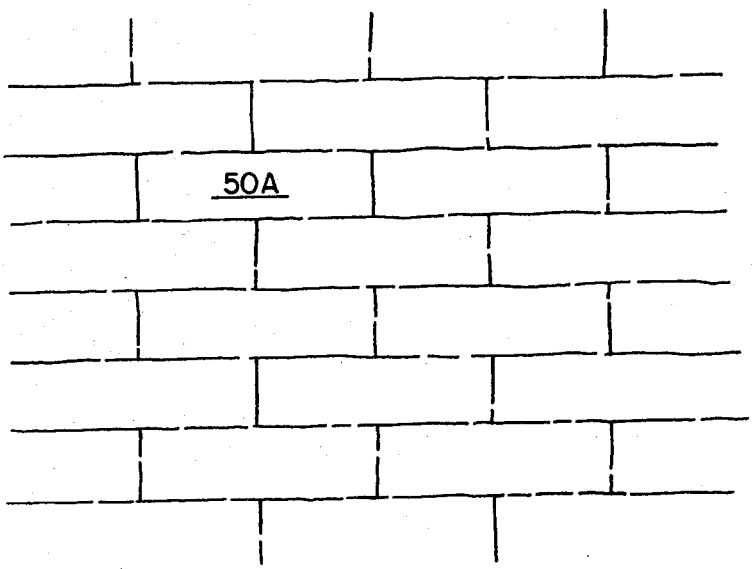
FIGS. 5A and 5B illustrate the obverse and rear surfaces, respectively, of the transfer sheet of FIG. 1 with background images or outlines thereon.
Figure 5B:
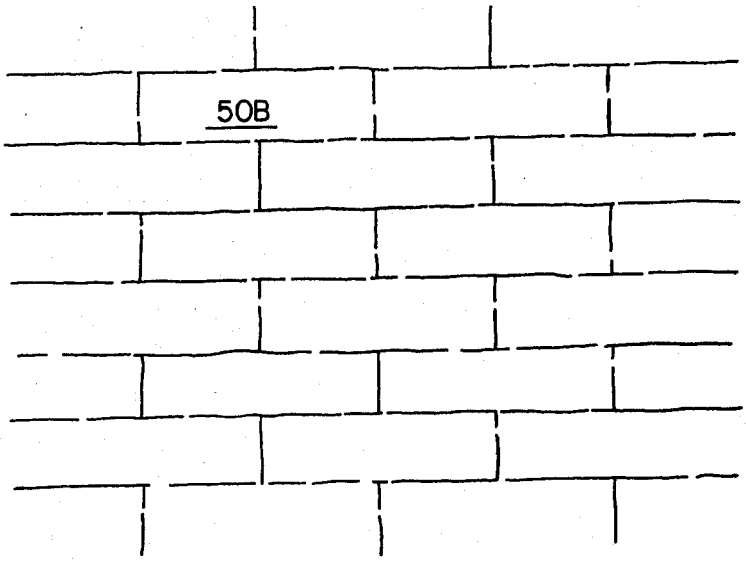

For example, the background pattern may be that of a brick wall on which graffitti is quite often written, as depicted in FIGS. 5A and 5B. FIG. 5A shows the obverse surface 50A of transfer sheet 50. The background or brick pattern on obverse surface 50A may merely be a black on white outline of the bricks to provide a guide or framework in which the free-hand artwork is generated. The background pattern on rear surface 50B may on the other hand be a coating of bright colored heat transferable inks or dyes. The pattern on surface 50B may be a single color or multicolored and may have other forms than the brick pattern described.

As stated hereinbefore the transfer sheet 50 may be transparent so that the background pattern of surface 50B is visible from obverse surface 50A. In such a case no pattern is needed on obverse surface 50A.

Figure 6:
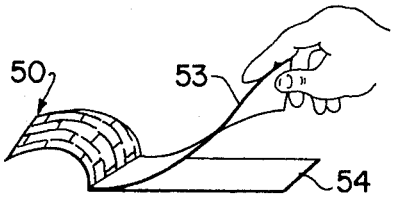
FIGS. 6 to 11 illustrated a sequence of method steps in which the transfer sheet of FIGS. 5A, 5B are utilized.

An example of how a brick background pattern of the type illustrated in 5A and 5B can be utilized is fully illustrated in FIGS. 6 through 11. As illustrated in FIG. 6, the kit of the present invention may comprise three (3) sheets attached or hinged along one edge including transfer sheet 50 and instruction sheet 53 which functions as a separator and copy sheet 54. The instruction sheet 53 may be slightly longer than transfer sheet 50 and copy sheet 54 so that when all three sheets are juxtaposed, one end of instruction sheet 53 extends beyond sheets 50 and 54. By gripping this extended end of sheet 53 with the fingers, transfer sheet 50 and copy sheet 54 may be separated and the instruction sheet 53 removed from the assembly. Also, transfer sheet 50 may be longer than copy sheet 54 to facilitate gripping on the extended end thereof.

Figure 7:
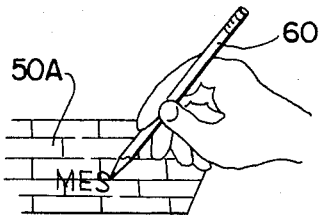

As illustrated in FIG. 7, the kit of the present invention is then ready for use. As shown in FIG. 7 the transfer sheet 50 with a copy sheet 54 thereunder is placed on a planar firm surface with obverse face 50A facing upwardly and a message, autograph, or other creative free-hand artwork is generated on obverse surface 50A. As illustrated in FIG. 7, the brick-work background pattern is visible on obverse surface 50A either by virtue of directly printing an outline of that pattern on obverse surface 50A or by providing a transparent transfer sheet which permits a background on the rear surface 50B to be visible through obverse surface 50A as described hereinbefore. It can be seen in FIG. 7 that the lines of the brick-work pattern provide good reference lines or a framework for writing a message on the obverse surface 50A of the transfer sheet. After this message is written onto obverse surface 50A the copy sheet 54 may be removed and disposed of.

Figure 8:
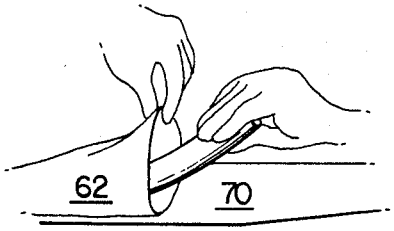

The next step is to place the T-shirt or similar type fabric on an ironing board or other similar padded surface as illustrated in FIG. 8. When using a T-shirt 62, it is advisable to place a protective sheet of plain paper between the front and back surfaces of the T-shirt to prevent ink from bleeding through to the other side.

Figure 9:
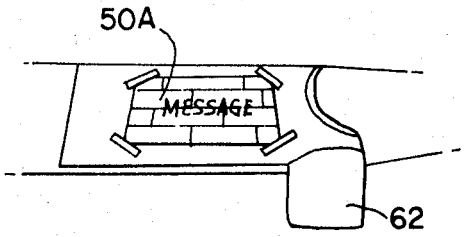

The iron should be preheated to a low cotton setting and the transfer sheet 50 including a message on its obverse surface 50A may be suitably secured, such as by transparent tape, to the T-shirt 62 as depicted in FIG. 9.

Figure 10:
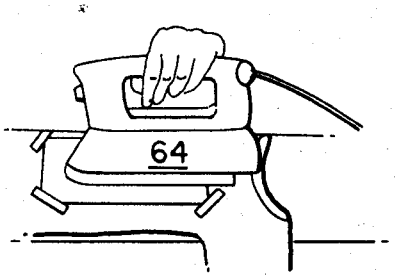

As illustrated in FIG. 10, the entire obverse surface 50A is then ironed with a slow, even motion to facilitate transfer of the negative image of the message on the rear surface of transfer sheet 50B and the brick-work pattern of heat transferable material, which is also on the rear surface 50B of transfer sheet 50.

Figure 11:
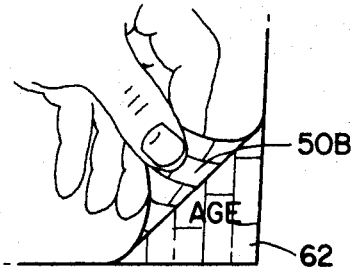

As illustrated in FIG. 11, the final colored pattern transferred to T-shirt 62 includes the free-hand message superimposed on the brick-work background pattern.

Accordingly, by process and kit of the present invention an individual can write, trace or draw with an ordinary pencil any creative design of his choosing onto the obverse surface of transfer sheet 50 for subsequent transfer in color to a T-shirt or similar fabric. Any errors in the free-hand artwork can simply be erased in most instances, or if too severe the transfer sheet 50 can be destroyed with only a nominal monetary loss, and a new transfer sheet prepared.

The obverse surface 50A may be coated in an attempt to enhance the smoothness with which the iron glides over surface 50A of the transfer sheet, or may be uncoated smooth paper.

If desired both the color from the copy sheet 54 and the background on the reverse surface 50B of the transfer sheet may be in iridescent colors that will glow in the dark. Accordingly, a T-shirt so treated will glow in the dark providing a safety function for the wearer who may be walking, skating or riding a bicycle in the dark. The use of iridescent inks may also have a large commercial value in the ever growing disco market.

As stated hereinbefore the heating step in any of the preferred embodiments may be replaced by the application of pressure to transfer the colored design.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of transfering a hand-formed design and a pre-printed background pattern from a transfer sheet to a fabric, comprising the steps of:

generating said design on the obverse surface of a transfer sheet by the application of energy thereto, while juxtaposing the rear surface of said transfer sheet with a layer of energy transferable material to provide a transferable mirror image of said design on the said rear surface, said transfer sheet including a pre-printed background pattern and said design being generated by creating said design by hand to apply said energy to said obverse surface, said pre-printed background pattern being formed of energy transferable material on the rear surface of said transfer sheet and being used as a guide with respect to which said design is created;

placing said rear surface containing said background pattern and said transferable mirror image of said design contiguous with a desired position on a surface of said fabric by visually aligning said design on said obverse surface with said desired position; and applying energy throughout the obverse surface of said transfer sheet to transfer both said mirror image of said design and said background pattern from said rear surface to said desired area on said fabric to thereby reproduce said design superimposed on said background pattern on said fabric.

2. The method of claim 1 wherein said energy applied by hand to create said design is pressure and said energy applied to transfer said design and background pattern to said fabric is heat.

* * * * *